US012338614B2

(12) United States Patent
Huang et al.

(10) Patent No.: US 12,338,614 B2
(45) Date of Patent: Jun. 24, 2025

(54) PRESSURE-ASSISTED FLUSH WATER TANK

(71) Applicant: ECO (XIAMEN) TECHNOLOGY INC., Fujian (CN)

(72) Inventors: Bingxing Huang, Xiamen (CN); Dongsheng Zhang, Xiamen (CN)

( * ) Notice: Subject to any disclaimer, the term of this patent is extended or adjusted under 35 U.S.C. 154(b) by 177 days.

(21) Appl. No.: 18/348,356

(22) Filed: Jul. 7, 2023

(65) Prior Publication Data

US 2024/0295108 A1 Sep. 5, 2024

(51) Int. Cl.
*E03D 3/10* (2006.01)
*E03D 1/01* (2006.01)
*E03D 1/33* (2006.01)

(52) U.S. Cl.
CPC ..... *E03D 3/10* (2013.01); *E03D 1/01* (2013.01); *E03D 1/33* (2013.01); *E03D 2201/20* (2013.01)

(58) Field of Classification Search
CPC .... E03D 3/10; E03D 1/01; E03D 1/33; E03D 2201/20
USPC ..... 4/332, 334, 354–362
See application file for complete search history.

(56) References Cited

U.S. PATENT DOCUMENTS

2005/0150038 A1* 7/2005 Li ..... E03D 3/10 4/354
2023/0313514 A1* 10/2023 Huang ..... E03D 3/10 4/362

FOREIGN PATENT DOCUMENTS

CN 114635481 A * 6/2022 ..... E03D 3/10

* cited by examiner

*Primary Examiner* — Tuan N Nguyen

(57) ABSTRACT

A pressure-assisted flush water tank includes a fluid container, a Venturi nozzle, a baffle and a buoy. The fluid container has an accommodating chamber, a water channel and an air channel. The accommodating chamber has a fluid inlet. The water channel and the air channel are in communication with the fluid inlet. The Venturi nozzle is disposed at a junction of the water channel and the fluid inlet. The baffle is configured to seal the air inlet in a movable manner. The buoy is disposed on an inner side of the air inlet. The top end of the buoy leans against the baffle. The buoy rises under internal pressure of the fluid container until the air inlet is closed. Before the buoy closes the air inlet, the protruding post abuts against and lifts up the baffle to open the air inlet.

10 Claims, 7 Drawing Sheets

PRESSURE-ASSISTED FLUSH WATER TANK

BACKGROUND OF THE INVENTION

1. Field of the Invention

The present invention relates to a pressure-assisted toilet flush system, and more particularly to a pressure-assisted flush water tank.

2. Description of the Prior Art

Under normal conditions, the pressure-assisted toilet flush system is in a closed state, and a certain amount of pressure energy is accumulated in the pressure-assisted water tank. When the user flushes the toilet (such as pressing the valve), the pressure balance of the system is broken. First, the drain hole of the pressure-assisted water tank is opened, and then the accumulated pressure is released to push the water in the pressure-assisted water tank to discharge, thereby generating a strong flushing force. Compared with the traditional toilet flush system that utilizes gravitational potential energy for drainage, the pressure-assisted toilet flush system uses less water to flush the toilet effectively. The pressure-assisted toilet flush system is not limited by the height of the water level, and it is more flexible and advantageous in terms of spatial layout.

The pressure energy accumulated in the pressure-assisted water tank is formed by replenishing water and air after drainage. After drainage, the pressure-assisted water tank replenishes water and air at the same time. The replenished air is accumulated in the upper part of the interior of the pressure-assisted water tank, and the replenished water is accumulated in the lower part of the interior of the pressure-assisted water tank to make the water level rise, thereby compressing the air to form pressure energy. When the air pressure inside the pressure-assisted water tank reaches a certain level, the air replenishment channel will be closed and the air replenishment will be stopped. At this time, the pressure of the entire pressure-assisted toilet flush system reaches a balance, and the water replenishment is stopped. The pressure-assisted toilet flush system is restored to be in a normal state. The water and air replenishment structure of the pressure-assisted water tank is the key to control the water level and air amount of the pressure-assisted water tank, and it is also the difficulty in the design of the pressure-assisted water tank. The existing pressure-assisted water tank has the problem of excessive air replenishment. As a result, water and air are out of synchronization during drainage. Bubbles and noise will be generated at the end of the drainage, which will affect the flushing effect and user experience.

SUMMARY OF THE INVENTION

The primary object of the present invention is to provide a pressure-assisted flush water tank, which can control the total amount of air flowing into the tank when refilling water and air so as to avoid excessive air pressure in the tank, thereby reducing the drainage noise when in use and improving user experience.

In order to achieve the foregoing object, the technical solutions of the present invention are described below.

A pressure-assisted flush water tank comprises a fluid container, a Venturi nozzle, a baffle and a buoy. The fluid container has an accommodating chamber, a water channel and an air channel. The accommodating chamber has a fluid inlet. The water channel and the air channel are in communication with the fluid inlet. A restricting ring is provided on an inner wall of the air channel. An air inlet is defined in the restricting ring. The Venturi nozzle is disposed at a junction of the water channel and the fluid inlet. The baffle is axially fitted on an outer side of the air inlet for sealing the air inlet in a movable manner. The baffle will not escape from the air channel. The buoy is disposed on an inner side of the air inlet. The buoy includes a protruding post on a top end thereof. The protruding post is movably inserted in the air inlet and abuts against the baffle. The buoy rises under internal pressure of the fluid container until the air inlet is closed. Before the buoy closes the air inlet, the protruding post abuts against and lifts up the baffle to open the air inlet.

The baffle is made of a soft rubber material.

A protruding ring is provided on a periphery of a lower surface of the baffle, facing the restricting ring.

An air-permeable block is provided on the outer side of the air inlet for axially restraining the baffle. The air-permeable block is a rubber block tightly fitted on an outer end of the air channel. The rubber block has a plurality of air holes.

Preferably, the baffle has a curved upper surface.

A first sealing ring is sleeved on a peripheral surface of an inlet end of the Venturi nozzle and embedded in an outlet end of the water channel.

The inner side of the air inlet has a sealing bevel. A second sealing ring is sleeved on a peripheral surface of the protruding post. The second sealing ring abuts against the sealing bevel along with movement of the buoy.

The pressure-assisted flush water tank further comprises a spring in the buoy. One end of the spring is embedded in the buoy, and another end of the spring abuts against an inner end of the air channel.

Preferably, a positioning post is provided on the inner end of the air channel for the spring to be sleeved thereon.

The fluid container includes a housing and a cover. The housing has the accommodating chamber, the fluid inlet, and a mounting groove for mounting the cover.

The fluid inlet is arranged on a bottom wall of the mounting groove. The cover has the water channel and the air channel. A third sealing ring is disposed between the cover and the mounting groove.

By adopting the above technical solutions, the present invention has the following technical effects:

The baffle is disposed on the outer side of the air inlet. At the initial stage of water replenishment for the fluid container, the negative pressure in the fluid container enables the baffle to be in tight contact with the air inlet to produce a sealing effect, thereby avoiding a large amount of air entering the container at the initial stage of water replenishment because the flow rate of the fluid is fast. In this way, the total amount of air can be controlled when the pressure-assisted flush water tank refills with water and air, so as to avoid excessive air pressure in the pressure-assisted flush water tank. Subsequent drainage won't generate a large number of air bubbles and can reduce noise, thereby improving the flushing effect and user experience.

DETAILED DESCRIPTION OF THE PREFERRED EMBODIMENTS

Figure 1:
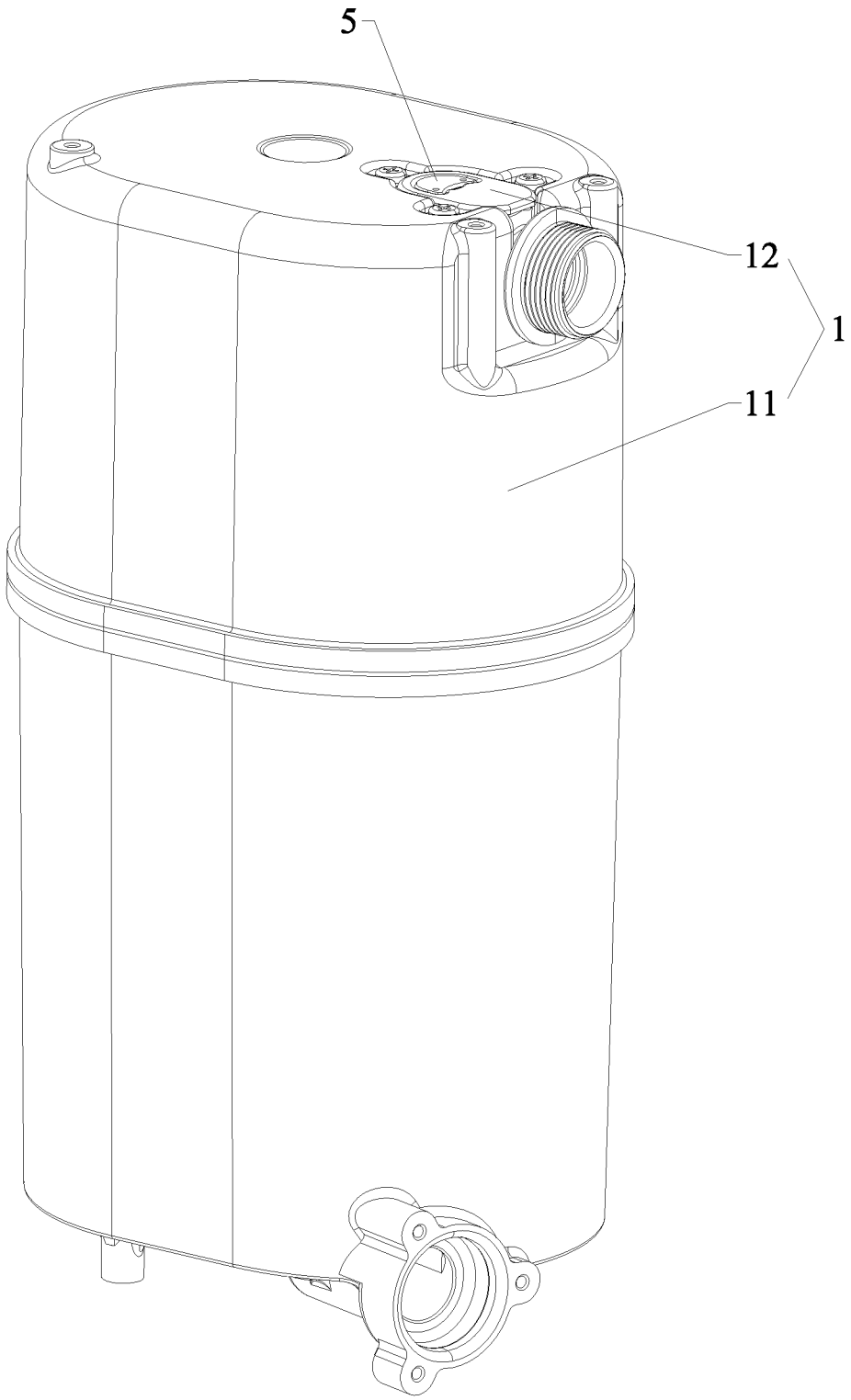
FIG. 1 is a perspective view according to a preferred embodiment of the present invention.
Figure 2:
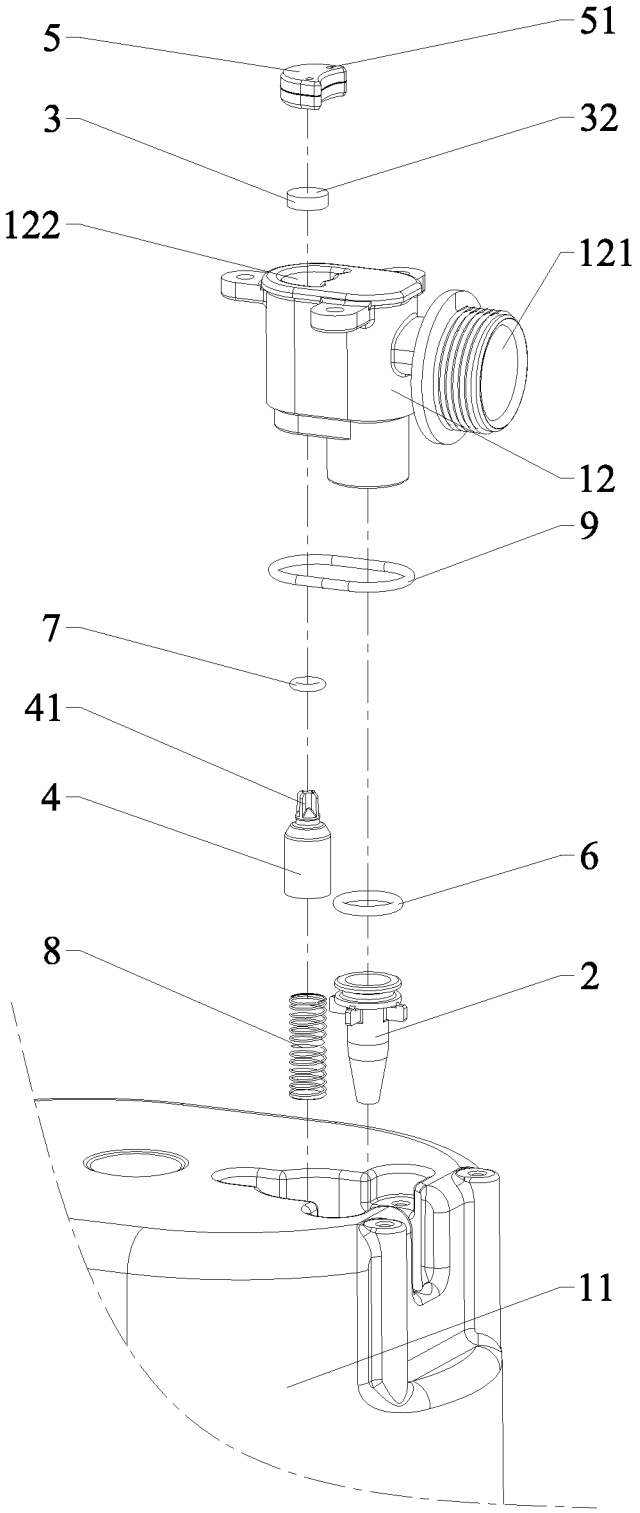
FIG. 2 is an exploded view according to the preferred embodiment of the present invention.
Figure 3:
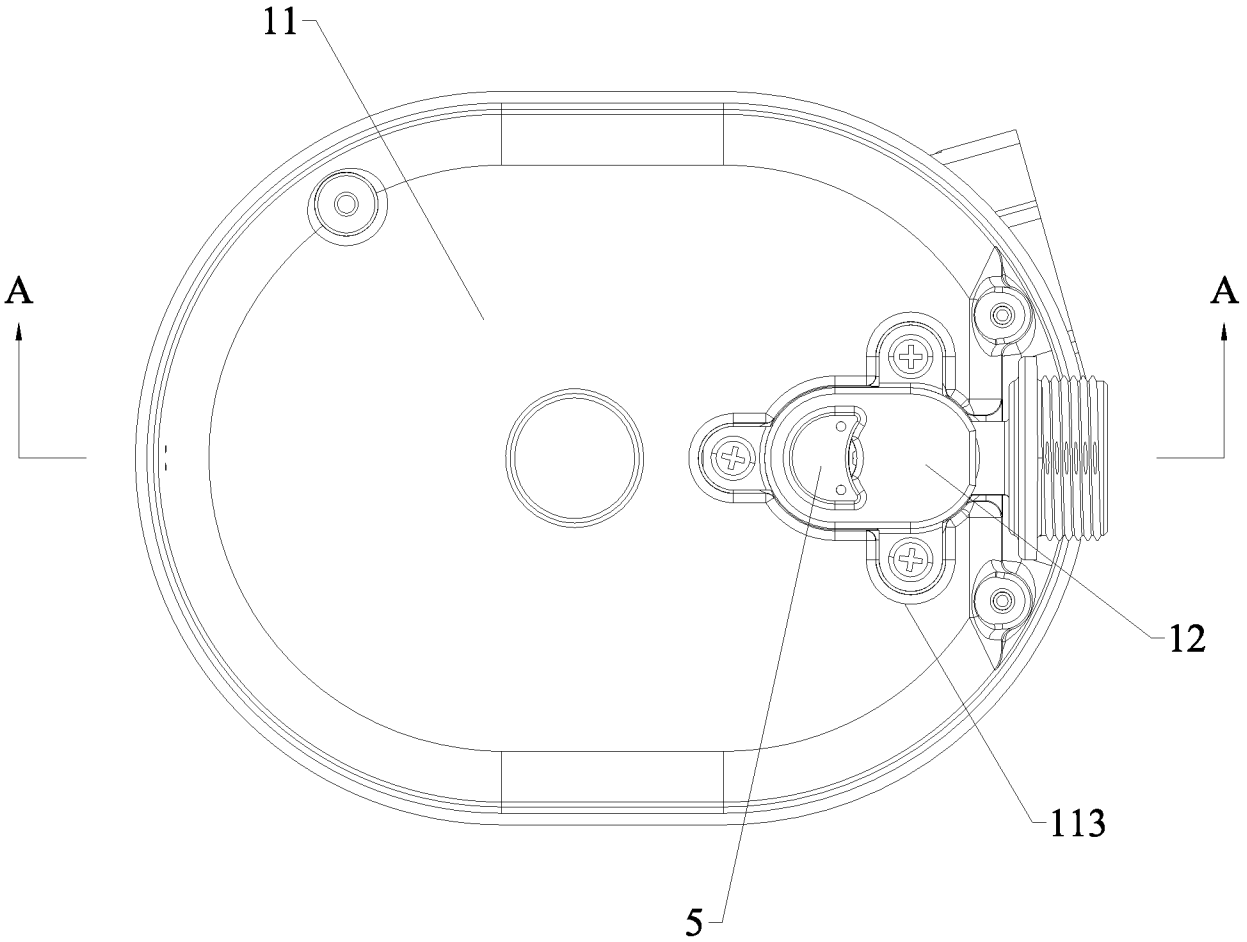
FIG. 3 is a top view according to the preferred embodiment of the present invention.
Figure 4:
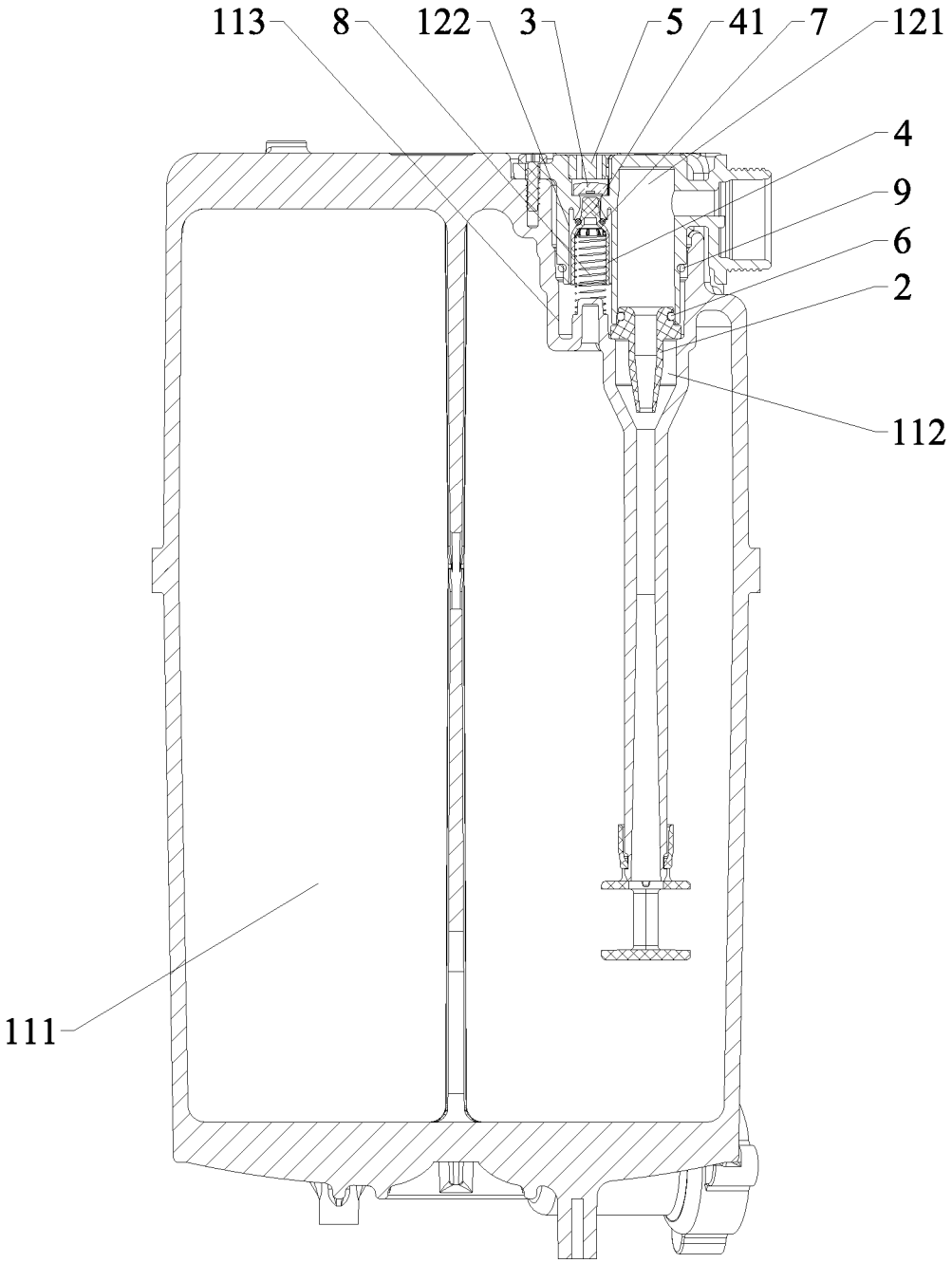
FIG. 4 is a cross-sectional view taken along line A-A of FIG. 3.

Embodiments of the present invention will now be described, by way of example only, with reference to the accompanying drawings.

Referring to FIG. 1 through FIG. 4, the present invention discloses a pressure-assisted flush water tank, comprising a fluid container 1, a Venturi nozzle 2, a baffle 3 and a buoy 4.

The fluid container 1 has an accommodating chamber 111, a water channel 121 and an air channel 122. The accommodating chamber 111 has a fluid inlet 112. Both the water channel 121 and the air channel 122 are in communication with the fluid inlet 112 from the outside of the fluid container 1. A restricting ring 123 is provided on the inner wall of the air channel 122. An air inlet 124 is defined in the restricting ring 123.

The Venturi nozzle 2 is disposed at the junction of the water channel 121 and the fluid inlet 112.

The baffle 3 is axially fitted on the outer side of the air inlet 124 for sealing the air inlet 124 in a movable manner and will not escape from the air channel 122.

The buoy 4 is disposed on the inner side of the air inlet 124. The buoy 4 includes a protruding post 41 on a top end thereof. The protruding post 41 is movably inserted in the air inlet 124 and abuts against the baffle 3. The buoy 4 rises under the internal pressure of the fluid container 1 until the air inlet 124 is closed. Before the buoy 4 closes the air inlet 124, the protruding post 41 abuts against and lifts up the baffle 3 to open the air inlet 124.

Specific embodiments of the present invention are described below.

The baffle 3 is made of a soft rubber material, which can be deformed to a certain extent under the action of atmospheric pressure, such that the baffle 3 is more likely to be in tight contact with the outer side of the air inlet 124 to achieve a sealing effect, so as to prevent air from entering the air inlet at the initial stage of water replenishment.

A protruding ring 31 is provided on the periphery of the lower surface of the baffle 3, facing the restricting ring 123, which can improve the sealing effect of the baffle 3. When the baffle 3 is in contact with the restricting ring 123 under the action of atmospheric pressure, because there is a certain space in the protruding ring 31, the middle portion of the baffle 3 will be deformed toward the protruding ring 31, so that the protruding ring 31 is in tight contact with the restricting ring 123.

The restricting ring 123 may be integrally formed with the air channel 122, and the strength is higher. The restricting ring 123 may be an accessory produced separately, and is secured in the air channel 122 by a tight fit or detachable connection, so as to achieve a detachable effect. Production of parts is easier.

An air-permeable block 5 is provided on the outer side of the air inlet 124 for axially restraining the baffle 3. In this embodiment, the air-permeable block 5 is a rubber block tightly fitted on the outer end of the air channel 122. The rubber block has a plurality of air holes 51. The rubber block having the air holes 51 not only has the function of restraining the baffle 3 but also enables the fluid container 1 to communicate with the atmosphere. The installation is more convenient. In addition, because the baffle 3 is made of a soft material, the air-permeable block 5 may be a raised portion integrally formed with the fluid container 1 and formed on the side wall of the air channel 122. The installation can be realized by forcing the baffle 3 into the raised portion.

Further, the baffle 3 has a curved upper surface 32 in an arc shape, which can reduce the contact area with the air-permeable block 5, thereby avoiding the problem that after the baffle 3 and the air-permeable block 5 are in close contact with each other (especially when water seepage may occur in the air inlet 124), the baffle 3 cannot be lowered again.

A first sealing ring 6 is sleeved on the peripheral surface of the inlet end of the Venturi nozzle 2 and embedded in the outlet end of the water channel 121.

The inner side of the air inlet 124 has a sealing bevel 125. A second sealing ring 7 is sleeved on the peripheral surface of the protruding post 41. The second sealing ring 7 abuts against the sealing bevel 125 along with movement of the buoy 4, so as to improve the sealing effect of the buoy 4.

The present invention further includes a spring 8 in the buoy 4. One end of the spring 8 is embedded in the buoy 4, and the other end of the spring 8 abuts against the inner end of the air channel 122. For example, a positioning post 114 is provided for the spring 8 to be sleeved thereon. The buoy 4 is usually made of lightweight material and can rise under the action of the internal pressure of the pressure-assisted flush water tank. The spring 8 provides auxiliary thrust to make the buoy 4 rise, preventing water seepage that may occur when the pressure at both ends of the buoy is at a critical balance point.

The fluid container 1 includes a housing 11 and a cover 12. The housing 11 has the accommodating chamber 111, the fluid inlet 112, and a mounting groove 113 for mounting the cover 12. The fluid inlet 112 is arranged on the bottom wall of the mounting groove 113. The cover 12 has the water channel 121 and the air channel 122. A third sealing ring 9 is disposed between the cover 12 and the mounting groove 113. The fluid container 1 is divided into two parts, which is beneficial for the molding of parts and technical features and for the assembly of the Venturi nozzle 2 and the buoy 4. Furthermore, the housing 11 may include upper and lower housing that are formed separately. Finally, the upper and lower housings are welded into an integral structure to form the housing 11. In this embodiment, the cover 12 is fastened on the top of the housing 11 by bolts.

The working principle of the present invention is described below.

Figure 5:
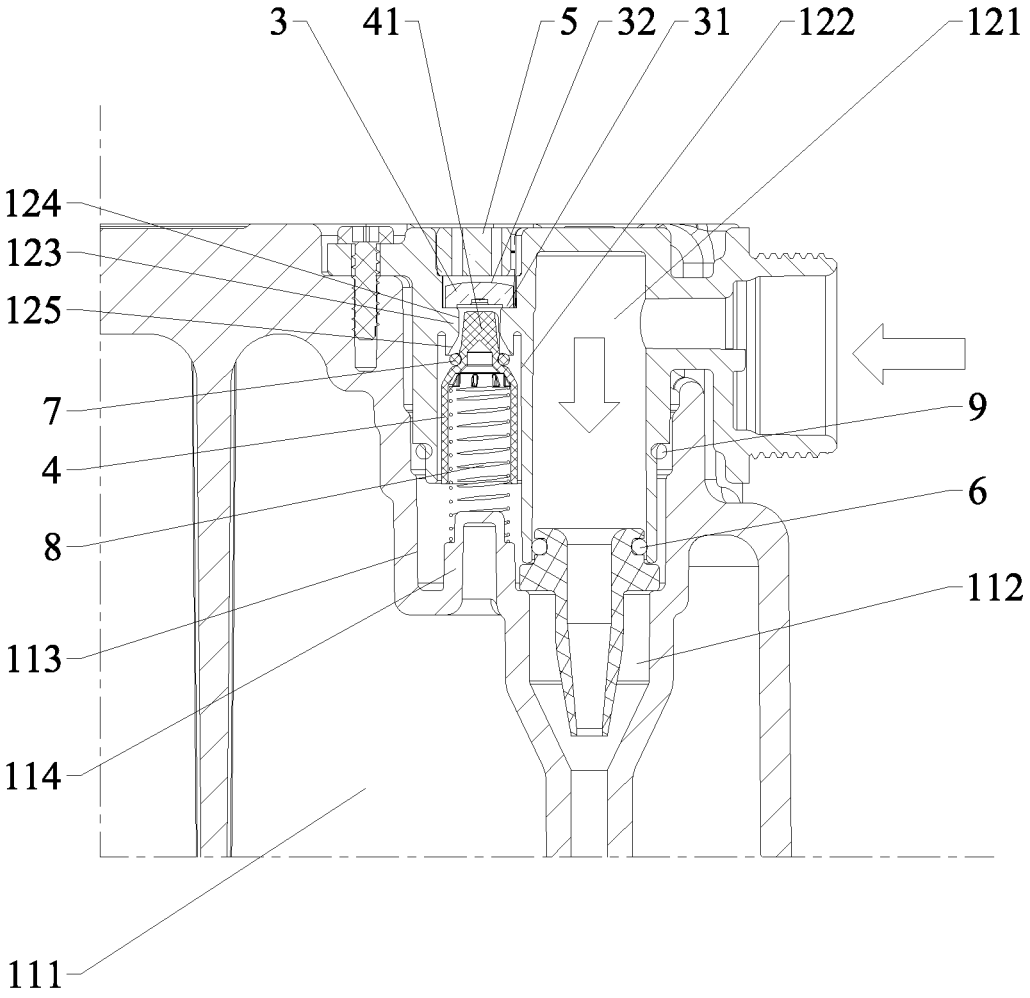
FIG. 5 is a schematic view of the initial stage of water replenishment according to the preferred embodiment of the present invention.

Referring to FIG. 5, at the initial stage of water replenishment, due to the acceleration of the water flow by the Venturi nozzle 2, a negative pressure is generated near the fluid inlet 112, and atmospheric pressure pushes the baffle 3 toward the air inlet 124. The baffle 3 closes the air inlet 124, so as to block air from entering the fluid container 1.

Figure 6:
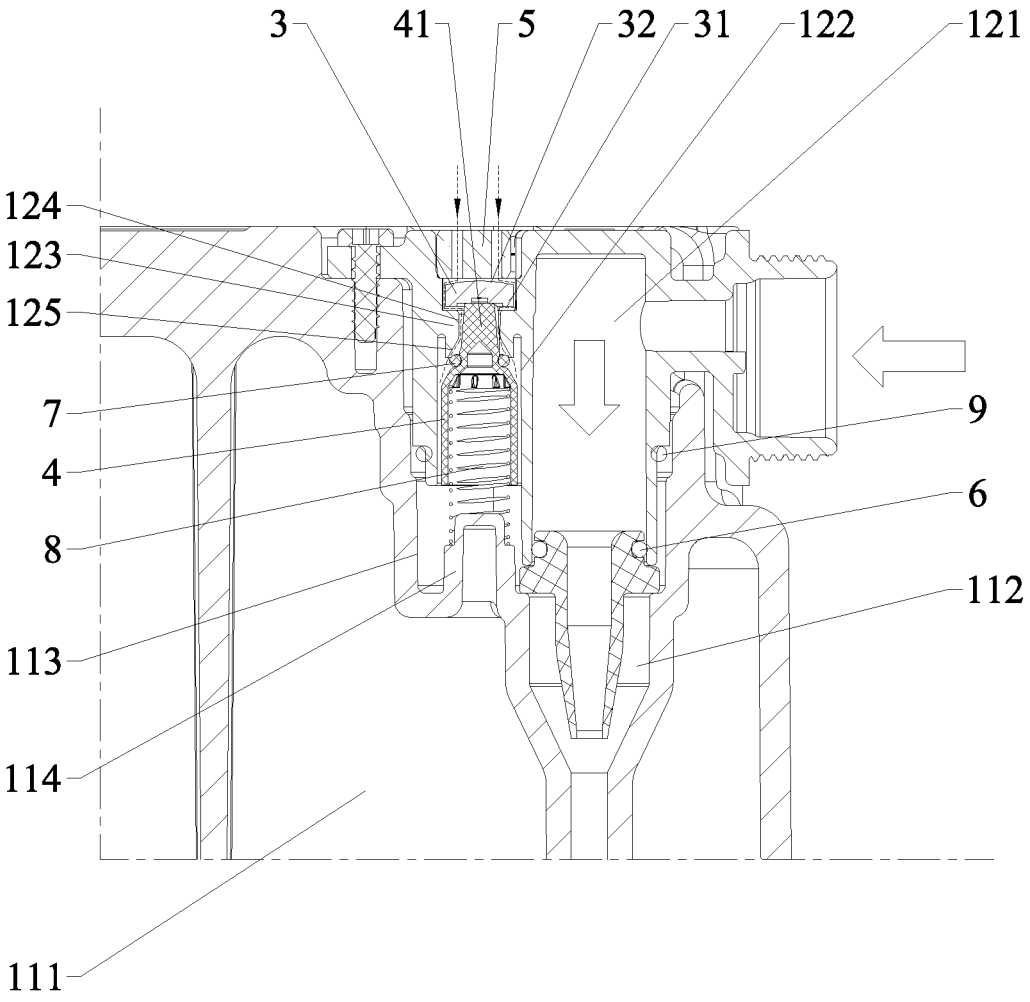
FIG. 6 is a schematic view of the middle stage of water replenishment according to the preferred embodiment of the present invention.

Referring to FIG. 6, at the middle stage of water replenishment, after the fluid container 1 is replenished with a certain amount of water, the pressure inside the fluid container 1 gradually increases, the pressure lifts the buoy 4, and the protruding post 41 of the buoy 4 lifts the baffle 3 to open the air inlet 124. At this time, the air flows into the fluid container 1, referring to the direction of the dotted line of FIG. 6.

Figure 7:
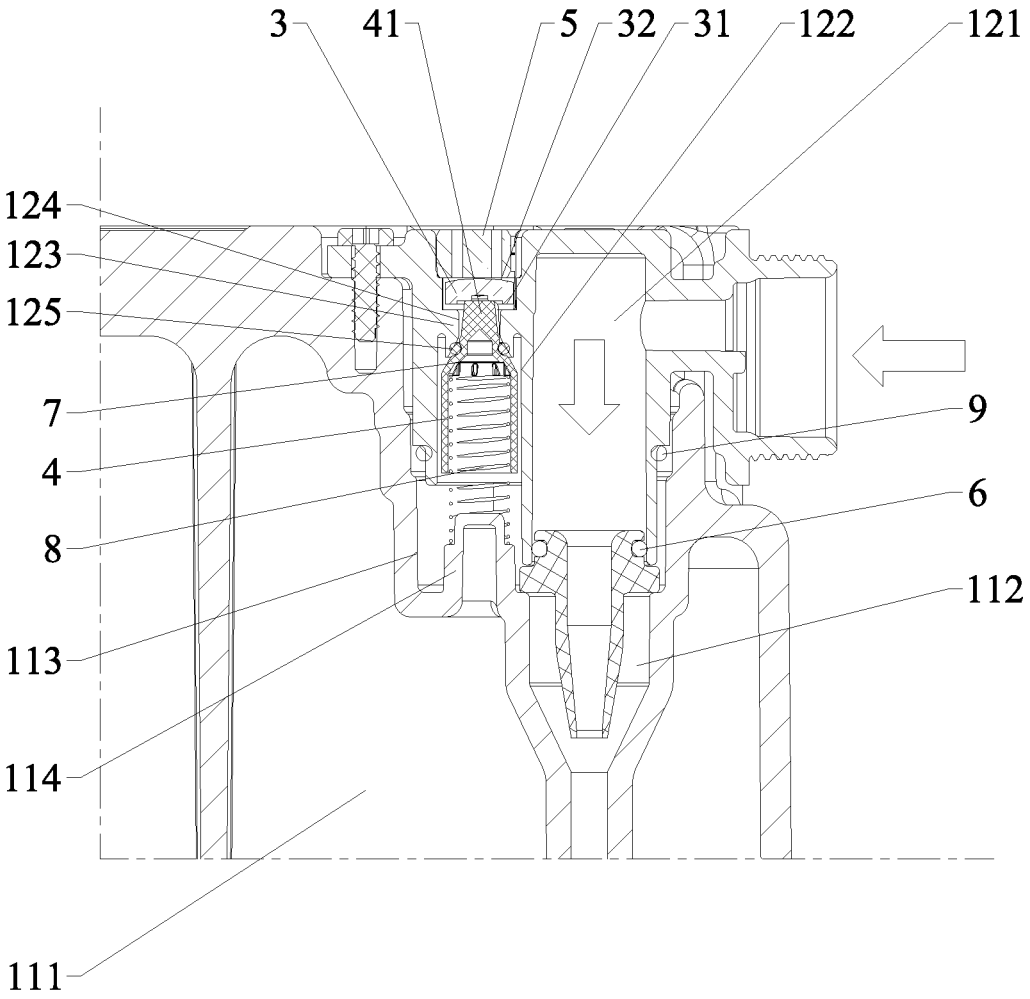
FIG. 7 is a schematic view of the final stage of water replenishment according to the preferred embodiment of the present invention.

Referring to FIG. 7, at the final stage of water replenishment, after the air flows into the fluid container 1 for a while, the buoy 4 blocks the inner side of the air inlet 124 and the air inlet 124 is closed again to block the air from entering the fluid container 1.

The structure of the present invention realizes that the air flows into the fluid container 1 only at the middle stage of water replenishment, so as to realize air replenishment. At the initial stage of water replenishment, the negative pressure is relatively large to block the air from entering the container. Thus, the air flowing into the container won't be excessive in the entire process of water replenishment.

With the above technical solutions, the present invention provides the baffle 3 on the outer side of the air inlet 124. At the initial stage of water replenishment for the fluid container 1, the negative pressure in the fluid container 1 enables the baffle 3 to be in tight contact with the air inlet 124 to produce a sealing effect, thereby avoiding a large amount of air entering the container at the initial stage of water replenishment because the flow rate of the fluid is fast. In this way, the total amount of air can be controlled when the pressure-assisted flush water tank refills with water and air, so as to avoid excessive air pressure in the pressure-assisted flush water tank. Subsequent drainage won't generate a large number of air bubbles and can reduce noise, thereby improving the flushing effect and user experience.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A pressure-assisted flush water tank, comprising a fluid container, a Venturi nozzle, a baffle and a buoy;

the fluid container having an accommodating chamber, a water channel and an air channel; the accommodating chamber having a fluid inlet, the water channel and the air channel being in communication with the fluid inlet; a restricting ring being provided on an inner wall of the air channel, an air inlet being defined in the restricting ring;

the Venturi nozzle being disposed at a junction of the water channel and the fluid inlet;

the baffle being axially fitted on an outer side of the air inlet for sealing the air inlet in a movable manner, wherein the baffle will not escape from the air channel;

the buoy being disposed on an inner side of the air inlet, the buoy including a protruding post on a top end thereof; the protruding post being movably inserted in the air inlet and abutting against the baffle; wherein the buoy rises under internal pressure of the fluid container until the air inlet is closed, before the buoy closes the air inlet, the protruding post abuts against and lifts up the baffle to open the air inlet.

2. The pressure-assisted flush water tank as claimed in claim 1, wherein the baffle is made of a soft rubber material.

3. The pressure-assisted flush water tank as claimed in claim 1, wherein a protruding ring is provided on a periphery of a lower surface of the baffle, facing the restricting ring.

4. The pressure-assisted flush water tank as claimed in claim 1, wherein an air-permeable block is provided on the outer side of the air inlet for axially restraining the baffle, the air-permeable block is a rubber block tightly fitted on an outer end of the air channel, and the rubber block has a plurality of air holes.

5. The pressure-assisted flush water tank as claimed in claim 4, wherein the baffle has a curved upper surface.

6. The pressure-assisted flush water tank as claimed in claim 1, wherein a first sealing ring is sleeved on a peripheral surface of an inlet end of the Venturi nozzle and embedded in an outlet end of the water channel.

7. The pressure-assisted flush water tank as claimed in claim 1, wherein the inner side of the air inlet has a sealing bevel; a second sealing ring is sleeved on a peripheral surface of the protruding post; the second sealing ring abuts against the sealing bevel along with movement of the buoy.

8. The pressure-assisted flush water tank as claimed in claim 1, further comprising a spring in the buoy, wherein one end of the spring is embedded in the buoy, and another end of the spring abuts against an inner end of the air channel.

9. The pressure-assisted flush water tank as claimed in claim 8, wherein a positioning post is provided on the inner end of the air channel for the spring to be sleeved thereon.

10. The pressure-assisted flush water tank as claimed in claim 1, wherein the fluid container includes a housing and a cover; the housing has the accommodating chamber, the fluid inlet, and a mounting groove for mounting the cover; the fluid inlet is arranged on a bottom wall of the mounting groove; the cover has the water channel and the air channel, and a third sealing ring is disposed between the cover and the mounting groove.

* * * * *